United States Patent [19]

Wagener et al.

[11] 4,308,102

[45] Dec. 29, 1981

[54] PROCESS AND APPARATUS FOR DRYING AND PREHEATING COKING COAL BY MEANS OF FLUE GAS

[75] Inventors: Dietrich Wagener; Claus Flockenhaus, both of Essen; Joachim F. Meckel, Heiligenhaus, all of Fed. Rep. of Germany

[73] Assignee: Didier Engineering GmbH, Essen, Fed. Rep. of Germany

[21] Appl. No.: 123,474

[22] Filed: Feb. 21, 1980

Related U.S. Application Data

[63] Continuation of Ser. No. 927,040, Jul. 24, 1978, abandoned.

[30] Foreign Application Priority Data

Aug. 26, 1977 [DE] Fed. Rep. of Germany ..... 2738442

[51] Int. Cl.[3] ..... C10B 39/02; C10B 39/04; C10B 57/00

[52] U.S. Cl. ..... 201/39; 201/41; 201/18; 202/227; 202/228

[58] Field of Search ..... 201/9, 39, 41; 34/35, 34/86; 432/77, 78, 82; 202/227–229

[56] References Cited

U.S. PATENT DOCUMENTS

| | | | |
|---|---|---|---|
| 3,728,230 | 4/1973 | Kemmetmueller | 202/228 X |
| 3,809,619 | 5/1974 | Drebes et al. | 202/227 X |
| 3,843,458 | 10/1974 | Kemmetmueller | 201/39 |
| 3,888,742 | 6/1975 | Kemmetmueller | 202/228 X |
| 3,959,084 | 5/1976 | Price | 201/39 |
| 3,992,266 | 11/1976 | Aktay et al. | 201/9 X |
| 4,002,535 | 1/1977 | Albright et al. | 201/9 |
| 4,009,080 | 2/1977 | Kurokawa et al. | 201/39 X |
| 4,053,364 | 10/1977 | Poersch et al. | 201/39 X |
| 4,076,593 | 2/1978 | Kolzumi et al. | 201/39 |
| 4,106,998 | 8/1978 | Okada et al. | 201/39 |

FOREIGN PATENT DOCUMENTS

| | | |
|---|---|---|
| 2434827 | 2/1975 | Fed. Rep. of Germany . |
| 2415250 | 2/1976 | Fed. Rep. of Germany . |
| 1334373 | 10/1973 | United Kingdom . |

*Primary Examiner*—Michael S. Marcus

*Attorney, Agent, or Firm*—Wenderoth, Lind & Ponack

[57] ABSTRACT

Flue gas discharged from a recuperator or regenerator of a coke oven battery has the steam thereof removed by means of a direct or indirect cooling and condensation operation. After the steam is removed from the flue gas it is then passed through a coke dry cooling plant in direct contact with hot coke therein to form dry cooled coke while simultaneously increasing the temperature of the flue gas. The flue gas is then passed through a coal preheating plant to directly contact and dry and preheat moist coking coal contained therein. The entire system is open, such that a given quantity of the flue gas passes only once through the system. When the temperature of the flue gas as received from a coke oven battery is extremely high, then the flue gas may be subjected to a partial cooling operation prior to the cooling and condensation operation. Further, a portion of the heat of the flue gas, after the discharge thereof from the coke dry cooling plant and prior to the introduction thereof into the coal preheating plant, may be used to generate steam and/or electricity.

18 Claims, 1 Drawing Figure

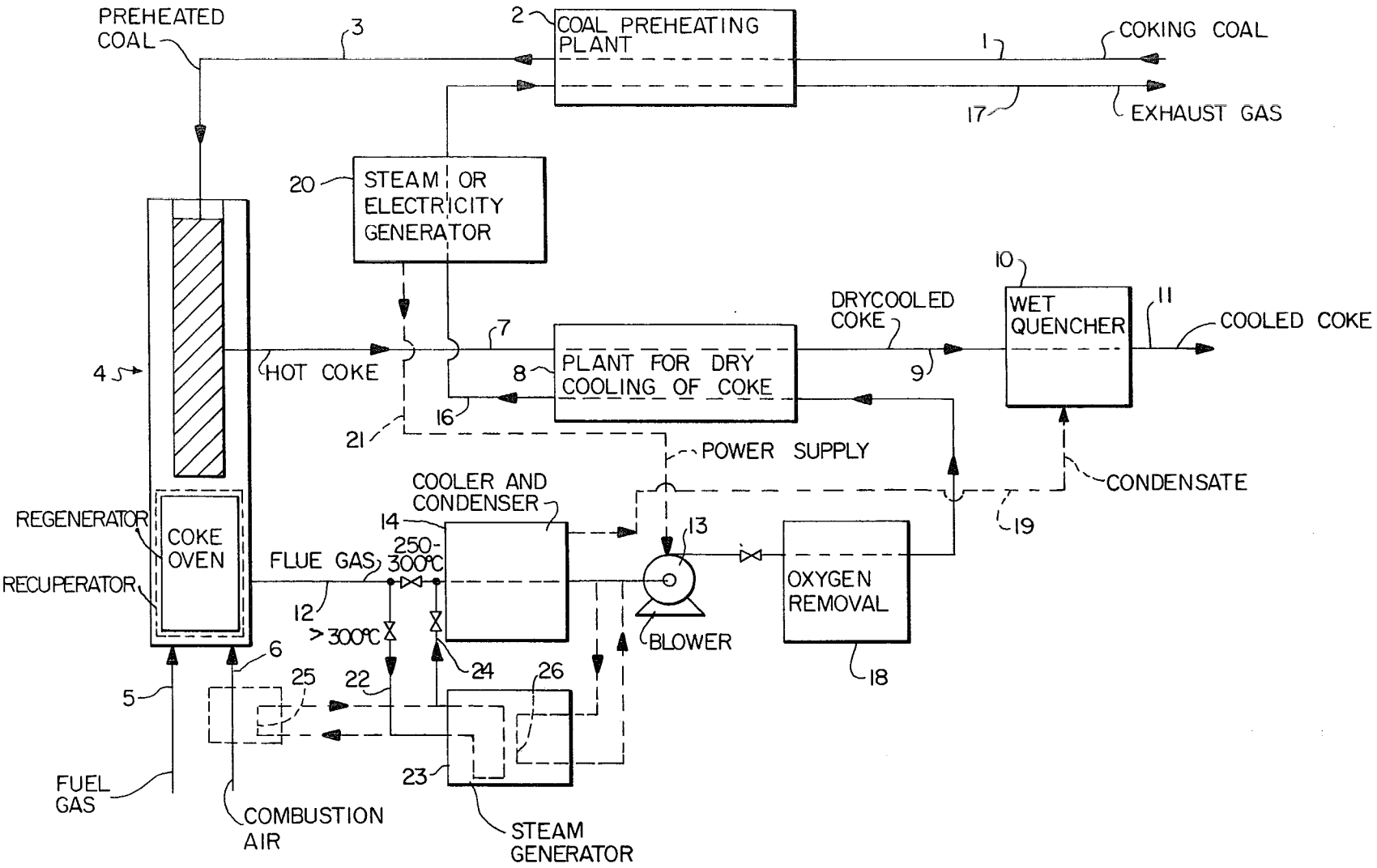
COKING COAL
EXHAUST GAS
COOLED COKE
CONDENSATE
WET QUENCHER
DRYCOOLED COKE
POWER SUPPLY
OXYGEN REMOVAL
COAL PREHEATING PLANT
PLANT FOR DRY COOLING OF COKE
BLOWER
STEAM OR ELECTRICITY GENERATOR
COOLER AND CONDENSER
STEAM GENERATOR
250-300°C
FLUE GAS
>300°C
HOT COKE
COMBUSTION AIR
PREHEATED COAL
COKE OVEN
REGENERATOR
RECUPERATOR
FUEL GAS
1
2
3
4
5
6
7
8
9
10
11
12
13
14
16
17
18
19
20
21
22
23
24
25
26

PROCESS AND APPARATUS FOR DRYING AND PREHEATING COKING COAL BY MEANS OF FLUE GAS

This is a continuation of application Ser. No. 927,040, filed July 24, 1980, now abandoned.

BACKGROUND OF THE INVENTION

The present invention relates to a process and apparatus for the utilization of the sensible heat of hot coke from a coking installation during the dry cooling of the coke preheating of moist coking coal, wherein a flue gas received from a coke oven battery is led in succession through the coke cooling plant and then through the coal preheating plant, in direct contact with the hot coke and moist coking coal, respectively.

British Pat. No. 1,334,373 discloses a system for employing the sensible heat of hot coke produced in a coking operation for the drying and/or preheating of coal. An inert gas is cycled through the hot coke and the coal, and the inert gas may form a portion of the combustion products of the fuel gases that are used for the coking operation. It is necessary to pretreat the heat carrier gas fed to the coke cooling plant by removal of oxygen therefrom, and also to pretreat the heat carrier gas which is passed to the coal preheating plant. In the operation of the British system it is necessary to provide a dust separator and a compression arrangement.

German DT-OS No. 24 15 758 discloses an installation combined with a coke dry quenching plant and employed for the continuous drying and preheating of coal while utilizing heat which is transferred from the hot coke to a mixed gas. There is provided a combined quenching gas cycle and drying gas passage, and the combined system includes a device for treating the gas after the drying operation to condense therefrom steam which is released during the drying operation, with there also being provided an after-combustion chamber. This known installation employs the gases produced in the combustion chamber as the heat carrier gas which is circulated in a completely closed cycle. Thus, the heat carrier gas must in this manner by continuously replenished and added to the cycle. This known installation also of necessity includes very spacious components such as dust removers, blowers, injection condensers, heat exchangers and an after-combustion chamber for burning water-gas components from the quenching operation. Accordingly, this known installation is very expensive both with regard to manufacture cost and operating cost.

German DT-OS No. 24 34 827 discloses a process for recovering energy during a gas generation process, for example a coal gasifying or coal coking operation, for the purpose of drying or preheating the starting material, in particular fine coal employed for the coking operation. This known process achieves drying and preheating of the starting material by means of waste heat obtained during the cooling of the solid residues of the process, for example during the dry quenching of coke from a coking plant. More particularly, a primary closed gas cycle derives heat from the cooling of the hot coke, and such primary closed cycle of necessity is equipped with a dust separator. Heat is transferred from this primary closed cycle to a heat transfer and drying agent such as an inert gas, for example nitrogen, a flue gas of a coke oven, or a flue gas obtained from the combustion of a waste gas. The heat transfer and drying agent is maintained in a secondary closed gas cycle which also of necessity includes a dust separator. Due to the fact that this known process employs two separate cycles, such process is expensive with regard to manufacturing cost, inasmuch as it requires numerous expensive components, such as heat exchangers, dust separators and blowers.

SUMMARY OF THE INVENTION

With the above discussion in mind, it is a primary object of the present invention to provide an improved process and apparatus for dry cooling hot coke after its discharge from a coke oven battery and for using the sensible heat of the hot coke thus achieved for drying and preheating moist coking coal prior to its introduction into the coke oven battery.

More particularly, the present invention is directed to such an improved process and apparatus which overcome all of the above discussed disadvantages of the prior art.

It is an even further object of the present invention to provide such an improved process and apparatus whereby it is possible to obtain a much more economical utilization of the sensible heat of the hot coke.

These objects are achieved in accordance with the present invention by removing the steam contained in the flue gas upon its receipt from the coke oven battery, prior to the passage of the flue gas through the coke dry cooling plant. The flue gas having steam removed therefrom is then passed through a coke dry cooling plant containing therein hot coke, thereby dry cooling the hot coke to form dry cooled coke while simultaneously increasing the temperature of the flue gas. The thus heated flue gas is then passed through a coal preheating plant containing therein moist coking coal, whereby the flue gas transfers its heat to the moist coking coal and thus dries and preheats the moist coking coal. The entire system is maintained completely open, and the flue gas is not continuously recirculated through the system. Specifically, after discharge from the coal preheating plant, the flue gas is exhausted to the atmosphere. A given portion of the flue gas is passed only once through the coke dry cooling plant and the coal preheating plant. The flue gas directly contacts the hot coke in the coke dry cooling plant, and the flue gas further directly contacts the moist coking coal in the coal drying and preheating plant.

Steam is removed from the flue gas as received from the coke oven battery by subjecting the flue gas to a direct or indirect cooling and condensation operation. The flue gas is thereby rendered substantially inert with respect to the hot coke contained in the coke dry cooling plant. The cooling and condensation operation may be achieved by any conventionally known equipment for achieving such purpose.

Due to the fact that the present invention employs a completely open system wherein the flue gas is passed only once through the coke dry cooling plant and the coal drying and preheating plant, the generation of a special inert gas is eliminated. The flue gas is itself rendered substantially inert by the relatively simple removal of steam therefrom. Since the system is open, as contrasted with closed systems of the prior art, it is unnecessary in accordance with the present invention to provide expensive elements such as heat exchangers and cleaning units which have been necessitated in prior art systems. Due to the fact that in accordance with the present invention steam is removed from the heat carrier gas, i.e. the flue gas, prior to the coke dry cooling operation, and since steam need be removed from a given quantity of flue gas only once, only a relatively small amount of steam need be removed from the heat carrier gas, as compared with prior art systems. Therefore, in accordance with the present invention the steam removal equipment, i.e. the cooler and condenser, is much smaller in size and thus much less expensive than in prior art systems.

The flue gas received from the coke oven battery may be subjected to various known preliminary treatments, such as for example the removal of oxygen, for example a catalytic oxygen removal, dust separation, or compression. It is to be understood that in carrying out the process of the present invention any such conventional preliminary treatments as are deemed necessary for a given installation may be employed. Since such preliminary treatments are conventional and form no portion of the present invention, they will not hereinafter be further described. However, it is to be understood that when the flue gas is received from a coke oven battery which is equipped with a recuperator, it will generally not be necessary to subject the flue gas to a preliminary treatment to remove oxygen from the flue gas. This is due to the fact that a coke oven battery equipped with a recuperative heat exchanger results in an almost stoichiometric combustion, as compared with a regenerative coke oven, so that the resultant flue gas has only a very low oxygen content.

In accordance with a further feature of the present invention, the sensible heat of the hot coke is used to an even further advantage and to an even more optimal extent by employing a portion of such sensible heat for the generation of steam and/or electricity. More particularly, the flue gas, after the discharge thereof from the coke dry cooling plant and prior to the introduction thereof into the coal drying and preheating plant, may be passed through a conventional steam and/or electricity generator, such that a portion of the sensible heat of the coke, carried by the flue gas, is utilized for the generation of steam and/or electricty. After the flue gas passes through such conventional steam and/or electricity generator, the flue gas is then passed through the coal drying and preheating plant and therein transfers the remainder of the sensible heat of the coke to the moist coking coal, thereby drying and preheating the moist coking coal.

The above discussed feature of the present invention is of particular advantage wherein the sensible heat of the coke carried by the flue gas is used for the generation of steam and/or electricity at a temperature range of the flue gas of approximately 1000° C. to 700° C., and wherein the sensible heat of the coke which is carried by the flue gas is employed for drying and preheating of the moist coking coal at a temperature range of the flue gas of approximately 700° C. to 150° C. More particularly, this division of heat utilization is optimally adapted to the particular functions involved. The high level of temperature of the flue gas is selected for the generation of steam and/or electricity in order to most efficiently employ such heat, for example to enable the production of highly superheated steam. This division of heat utilization further makes it possible to substantially avoid any large losses of residual heat. It is to be understood that a particular installation will be adapted such that the flue gas will yield to the moist coking coal the necessary quantity of sensible heat required to dry and preheat the coal to a desired extent. The particular installation will be adjusted such that any available heat in excess of the amount necessary to dry and preheat the coal to the desired extent will be made available for the generation of steam and/or electricity. The amount of excess heat, and therefore the desired temperature ranges for the steam and/or electricity generation and the coal drying and preheating operations, will of course vary as a function of the water content of the moist coking coal. For example, a substantially larger amount of heat will be available for the generation of steam and/or electrically when the coal to thereafter be dried and preheated has a relatively low content of water. The steam and/or electricity generated in this manner may be employed for various purposes, but in accordance with a specific feature of the present invention may be employed as a power supply or source for operating a blower or plurality of blowers that are used for conveying the flue gas through the system.

Flue gas which is available from conventional coke oven batteries is normally at a temperature of approximately 250° C. to 300° C., and flue gas at such temperature may be readily cooled and condensed with a relatively small cooler and condenser in order to remove steam in accordance with the present invention. However, if the coke oven battery is such that the available flue gas is at a substantially higher temperature, then it may be desirable to subject the flue gas to a preliminary or partial cooling operation prior to the cooling and condensation operation. For example, of the coke oven battery includes a so-called "short recuperator" as disclosed in German Patent Application No. P 27 15 536.8, the flue gas outlet temperature may be substantially above 300° C., for example approximately 600° C. Therefore, the flue gas may be partially cooled prior to subjecting the flue gas to the cooling and condensation operation. Such partial cooling may be achieved by passing the flue gas in heat exchange relation with combustion air supplied to the coke oven battery for the formation therein of the coke, by passing the flue gas in heat exchange relation with flue gas which has already been subjected to the cooling and condensation operation, or by passing the flue gas through a steam generator, whereby a portion of the heat of the flue gas is employed for the generation of steam.

Since during the coke dry cooling operation, it is impossible to entirely avoid the formation of a certain amount of dust, then in accordance with a further feature of the present invention, the dry cooled coke may be subjected to a wet quenching operation. In accordance with a still further feature of the present invention, such wet quenching may be achieved by employing the condensate obtained from the cooling and condensation operation. Further, the flue gas may be conveyed through the system by positive blowers or suction devices arranged in the open system.

Accordingly, in accordance with the present invention the entire system is maintained in a single open cycle rather than in a closed and possibly plural cycle system as is conventional in prior art devices. Since the flue gas is continually produced in the adjacent coke oven battery and is thus constantly and readily available, the heat carrier gas is led only a single time through the various stages of the open cycle of the system of the present invention. Therefore, it is completely unnecessary to provide the system with means for continuously regenerating or recirculating the heat carrier gas, as is necessary in closed prior art installations which inherently develop leaks. Furthermore, since prior art installations include a closed system, the heat carrier gas passing through the coal drying and preheating plant inherently absorbed moisture from the moist coking coal. In a closed system whereby the heat carrier gas is continually recirculated therethrough, it is necessary to provide within the closed system a relatively high capacity condenser device. However, in accordance with the present invention, since the system is entirely open, and since the flue gas is condensed prior to use in the coal drying and preheating plant, it is possible to provide a condenser having a relatively low capacity and therefore small size.

BRIEF DESCRIPTION OF THE DRAWING

Other objects, features and advantages of the present invention will be apparent from the following detailed description, taken with the accompanying single drawing FIGURE which schematically illustrates one embodiment of the various features of the process and apparatus of the present invention.

DETAILED DESCRIPTION OF THE INVENTION

With reference now to the drawing, coking coal is supplied in a known manner, as illustrated schematically at 1, to a coal preheating plant 2 and is dried and preheated therein in a manner to be described in more detail below. The dried and preheated coal is then supplied as at 3 and in a conventional manner to a conventional coke oven battery 4 including conventional coke ovens, conventional regenerators and conventional recuperators. Fuel gas and combustion air are supplied to the coke oven battery in a known manner, as schematically shown at 5 and 6, respectively. After the formation of coke in the coke oven battery, hot coke is removed in a conventional manner as shown at 7 and is supplied to a plant 8 for the dry cooling of the coke. The dry cooling of the coke will be described in more detail below. The dry cooled coke is then transferred from plant 8 in a conventional manner as at 9 and may be passed through a wet quencher 10 to be further cooled. The finally cooled coke is then removed as at 11 for further use in a known manner as will be understood by those skilled in the art.

The above described features are all conventional, and therefore no further description thereof is necessary.

However, in accordance with the present invention, there is provided a novel process and apparatus for utilizing the sensible heat of the hot coke which is removed from the coke oven battery 4 to both dry cool the coke in plant 8 and to dry and preheat the moist coking coal in plant 2.

More particularly, in accordance with the present invention, flue gas is removed from a regenerator or recuperator of the coke oven battery 4, as shown at 12, and by means such as blower 13. Prior to the flue gas being supplied to the coke dry cooling plant 8, the flue gas is subjected to a cooling and condensation operation such that steam is removed from the flue gas. For example, the flue gas may be passed through a cooler and condenser 14 which may be of any known and conventional structure for removing the steam from the flue gas. The flue gas is then introduced into coke dry cooling plant 8, wherein the flue gas is brought into direct contact with the hot coke within plant 8. This dry cools the coke and simultaneously substantially increases the temperature of the flue gas. The thereby heated flue gas is then led from plant 8, as at 16 into the coal drying and preheating plant 2 and into direct contact with the moist coking coal therein, whereby the hot flue gas releases its heat to the moist coking coal, thereby drying and preheating the coking coal to a desired temperature. The thereby cooled flue gas is then discharged from the coal preheating plant 2, for example as exhaust gas to the atmosphere, as at 17.

By the above arrangement wherein the flue gas is passed through both the coke dry cooling plant and the coal drying and preheating plant, it is possible to avoid the necessity of providing separate circuits as is necessary in many prior art systems. Furthermore, by providing that the entire system is completely open, in contrast to closed circuits in accordance with prior art installations, it is totally unnecessary to provide the system with means for continuously regenerating or recirculating the heat carrier gas to provide a continual replacement therefor. Such replacement means have been required in prior art installations employing closed cycles that unavoidably develop leaks. Furthermore, in accordance with the present invention the amount of steam removed from the flue gas prior to its one-time passage through the system is much lower than the amount of moisture removed from the coal during the coal drying operation. Also, as indicated above, the system of the present invention is entirely open, such that any moisture absorbed from the drying of the moist coal may be exhausted to the atmosphere. In contrast, prior art systems having closed cycles absolutely required the provision of a condenser to condense from the enclosed heat carrier gas moisture absorbed thereby after each passage of the heat carrier gas through the coal preheating plant. Failure to condense such moisture after each cycle of the heat carrier gas would of course result in a steady buildup of the water content of the heat carrier gas. Accordingly, it will be apparent that the condenser necessary in the system of the present invention may be of a much smaller capacity and therefore much less expensive than the condenser which is necessary in prior art systems.

It is to be understood that the flue gas, prior to its introduction into the coke dry cooling plant 8, may be subjected, as necessary in a particular case, to various conventional pretreatment operations. For example, the flue gas may be subjected to an oxygen removal operation, as schematically indicated at 18. Such oxygen removal may be by catalytic means or any other conventional and known means. Additionally, other pretreatment operations, for example dust removal or compression, may be provided.

During the dry cooling operation in plant 8, it is unavoidable that a certain amount of dust is formed. Therefore, the dry cooled coke is cooled in wet quencher 10. Furthermore, in accordance with an additional feature of the present invention, the condensate removed from the flue gas in the cooler and condenser 14 may be supplied as at 19 to the wet quencher 10 in carrying out the wet quenching of the dry cooled coke.

The sensible heat from the coke, carried by the flue gas which is discharged from the plant 8, can be even further optimally utilized by employing a portion of such sensible heat for generating steam and/or electricity. More particularly, the flue gas discharged from plant 8, containing a substantial amount of sensible heat from the hot coke, may be passed through a conventional steam and/or electricity generator 20 to thereby generate steam and/or electricity. A portion of the sensible heat carried by the flue gas will be expended in the generation of such steam and/or electricity. The flue gas, carrying the remainder of the sensible heat, is then passed to the coal preheating plant 2 to dry and preheat the moist coking coal in the manner discussed above. It is to be understood that the steam and/or electricity generator 20 may be any known and conventional such generator as will be understood by those skilled in the art.

In accordance with a further feature of the present invention, at least a portion of the steam and/or electricity generated in generator 20 may be employed as the power source or supply for operating the blower or blowers which convey the flue gas through the system. For example, steam and/or electricity obtained from generator 20 may be supplied as at 21 to operate blower 13.

This division of the utilization of the sensible heat of the hot coke is particularly advantageous when the flue gas passing through generator 20 is at a temperature range of approximately 1000° C. to 700° C., and when the flue gas passing through the coke drying and preheating plant 2 is at a temperature range of approximately 700° C. to 150° C. Thus, the sensible heat is particularly adapted to individual different usages. For example, the high temperature level is selected for operation of generator 20 in order to produce a highly superheated steam. It will be understood that a particular installation will be adapted as necessary, for example dependent upon the moisture content of the moist coking coal, to ensure that a sufficient amount of the sensible heat is supplied to plant 2 to ensure satisfactory drying and preheating of the coal, with any residual heat being available for the operation of generator 20.

Flue gas is normally available from a coke oven battery at a temperature of approximately 250° C. to 300° C., and under such conditions it is possible to employ a relatively small sized cooler and condenser 14 to remove the steam from the flue gas. However, under certain conditions the flue gas is supplied from the coke oven battery at a much higher temperature, and under such circumstances it is desirable to preliminarily partially cool the flue gas prior to its introduction into cooler and condenser 14. Specifically, if the coke oven battery is equipped with a so-called "short recuperator" as disclosed in German Patent Application No. P 27 15 536.8, the flue gas outlet temperature is much higher than 300° C., for example approximately 600° C. It is therefore desirable to preliminarily partially cool the flue gas before the cooling and condensation operation.

In accordance with one embodiment of the present invention, the flue gas, prior to passage through cooler and condenser 14, may be passed as at 22 through a known type of steam generator 23, to thereby employ a portion of the heat of the flue gas to generate steam and to thereby preliminarily cool the flue gas. The thus preliminarily cooled flue gas is then passed as at 24 to cooler and condenser 14. It is specifically to be understood that steam generator 23 may be of any known and conventional configuration.

In accordance with a modified embodiment of the present invention, the flue gas, prior to passage through cooler and condenser 14, may be passed via line 22 and line 25 in heat exchange relationship with the combustion air which is supplied to the coke oven battery, to thereby preliminarily cool the flue gas. The thus preliminarily cooled flue gas is then passed through line 24 to cooler and condenser 14.

In accordance with an even further modified embodiment of the present invention, the flue gas, prior to passage through cooler and condenser 14, may be passed, as at lines 22 and 24, in heat exchange relationship with flue gas which has already been subjected to the cooling and condensing operation. Specifically, at least a portion of the flue gas which is discharged from cooler and condenser 14 may be passed as at 26 in heat exchange relationship with the hot flue gas passing through lines 22 and 24, thereby preliminarily cooling the hot flue gas. The preliminarily cooled flue gas is then passed via pipe 24 to cooler and condenser 14.

According to the present invention, the flue gas is passed both through the coke dry cooling plant 8 in direct contact with the hot coke and also through the coal drying and preheating plant 2 in direct contact with the moist coking coal in a single open cycle, rather than in a closed cycle as is conventional in the prior art. Since the flue gas is continuously produced and is thus constantly available, the flue gas is led only a single time through the various stages of the open cycle of the system. Therefore, it is totally unnecessary to provide the system with means for continuously regenerating or recirculating the heat carrier gas to provide a continual replacement therefor, such as is necessary in prior art installations employing closed cycles that develop leaks.

Furthermore, the flue gas having the steam removed therefrom acts with a low water content on the moist coking coal during the coal drying and preheating operation. Therefore, the ratio of the water content of the moist coking coal to the water content of the flue gas is very high, and is specifically much higher than in known pneumatic coal drying processes. It will of course be readily apparent that such high water content ratios are particularly advantageous for the coal drying operation. Furthermore, in accordance with the present invention, the sensible heat from the hot coke is employed not only for the drying and preheating of the moist coking coal, but also for the generation of steam and/or electricity.

Therefore, in view of the above discussion, it will be apparent that the process and apparatus of the present invention utilize with great economy the waste heat of the solid residues of the coking operation. By employing a single heat carrier gas for all stages of the process, it is not necessary to employ a fine dust separator subsequent to the coke dry cooling operation. Therefore, it will be apparent that the system of the present invention employs fewer components than are necessary in prior art installations and that thus the system of the present invention is less expensive.

It is to be understood that with the exception of the above discussed novel features of the present invention, the various other components and elements of the system of the present invention are intended to be conventional. For example, the coke oven battery 4 and the various elements thereof, including coke ovens, regenerators and recuperators, may be any such known structural element, with the exception of the novel features of the present invention as hereinabove discussed. Furthermore, the coke dry cooling plant 8, the coal preheating plant 2, the wet quencher 10, the cooler and condenser 14, the steam and/or electricity generator 20, and the steam generator 23 may also be conventionally and commercially available such items, with the exception that such elements are modified as necessary to be employed in the overall system of the present invention as discussed hereinabove.

Although the process and apparatus of the present invention have been described and illustrated with respect to preferred features thereof, it will be apparent that various modifications may be made to such features without departing from the scope of the present invention.

What we claim is:

1. A process for cooling hot coke after its discharge from a coke oven battery and for drying and preheating moist coking coal prior to its introduction into said coke oven battery to be formed therein into coke, said process comprising:

withdrawing flue gas from said coke oven battery and removing steam from said withdrawn flue gas;

then passing said flue gas through a coke dry cooling plant containing said hot coke and therein directly contacting said flue gas with said hot coke and dry cooling said hot coke to form dry cooled coke while simultaneously increasing the temperature of said flue gas;

then passing said flue gas through a coal preheating plant containing said moist coking coal and therein directly contacting said flue gas with said moist coking coal and drying and preheating said moist coking coal by transfer of heat thereto from said flue gas; and discharging said flue gas to the atmosphere directly after the passage of said flue gas through said coal preheating plant, and thereby maintaining said flue gas in an open system by passing given said flue gas only once through said coke dry cooling plant and said coal preheating plant and not continuously circulating such given flue gas therethrough.

2. A process as claimed in claim 1, wherein said withdrawing comprises removing said flue gas from a recuperative heat exchanger of said coke oven battery.

3. A process as claimed in claim 1, wherein said steam removing comprises removing steam from said flue gas prior to the introduction thereof into said coke dry cooling plant by subjecting said flue gas to a cooling and condensation operation.

4. A process as claimed in claim 3, further comprising wet quenching said dry cooled coke with condensate obtained from said cooling and condensation operation.

5. A process as claimed in claim 3, further comprising, prior to subjecting said flue gas to said cooling and condensation operation, partially cooling said flue gas by passing said flue gas in heat exchange relation with combustion air supplied to said coke oven battery for the formation therein of said coke.

6. A process as claimed in claim 3, further comprising, prior to subjecting said flue gas to said cooling and condensation operation, partially cooling said flue gas by passing said flue gas in heat exchange relation with flue gas which has already been subjected to said cooling and condensation operation.

7. A process as claimed in claim 3, further comprising, prior to subjecting said flue gas to said cooling and condensation operation, partially cooling said flue gas by passing said flue gas through a steam generator, whereby a portion of the heat of said flue gas is employed for the generation of steam.

8. A process as claimed in claim 1, further comprising removing a portion of the heat of said flue gas, after the discharge thereof from said coke dry cooling plant and prior to the introduction thereof into said coal preheating plant, by generating steam and/or electricity.

9. A process as claimed in claim 8, comprising removing said portion of the heat of said flue gas for the generation of steam and/or electricity at a temperature range of said flue gas of approximately 1000° C. to 700° C., and drying and preheating said moist coking coal at a temperature range of said flue gas of approximately 700° C. to 150° C.

10. A process as claimed in claim 8, comprising conveying said flue gas through said system by at least one blower, and employing said steam and/or electricity generated during said removal of said portion of the heat of said flue gas to operate said blower.

11. In a system including a coke oven battery for receiving therein coal for the formation of coke, the improvement of an apparatus for dry cooling hot coke after its discharge from said coke oven battery and for drying and preheating moist coking coal prior to its introduction into said coke oven battery to be formed therein into coke, said apparatus comprising:

a coke dry cooling plant positioned to receive therein hot coke from said coke oven battery;

a coal drying and preheating plant adapted to receive therein moist coking coal prior to the introduction thereof into said coke oven battery;

means for passing flue gas from said coke oven battery through said coke dry cooling plant and therein directly contacting said flue gas with said hot coke and dry cooling said hot coke to form dry cooled coke while simultaneously increasing the temperature of said flue gas, and for then passing said flue gas through said coal drying and preheating plant and therein directly contacting said flue gas with said moist coking coal and drying and preheating said moist coking coal by transfer of heat thereto from said flue gas;

means for removing steam from said flue gas prior to the introduction of said flue gas into said coke dry cooling plant; and means for discharging said flue gas to the atmosphere, directly after the passage of said flue gas through said coal drying and preheating plant, whereby the complete passage of said flue gas through said steam removing means, said coke dry cooling plant and said coal drying and preheating plant is an open system such that said flue gas is not continuously recirculated therethrough.

12. An apparatus as claimed in claim 11, wherein said steam removing means comprises a cooler and condenser stage for subjecting said flue gas to a cooling and condensing operation.

13. An apparatus as claimed in claim 12, further comprising a wet quencher positioned to further quench said dry cooled coke after discharge thereof from said coke dry cooling plant, and means for employing condensate obtained from said cooling and condensation operation as the quenching agent of said wet quencher.

14. An apparatus as claimed in claim 12, further comprising means for partially cooling said flue gas, prior to said cooling and condensation operation, by passing said flue gas in heat exchange relation with combustion air supplied to the coke oven battery for the formation therein of said coke.

15. An apparatus as claimed in claim 12, further comprising means for partially cooling said flue gas, prior to said cooling and condensation operation, by passing said flue gas in heat exchange relation with flue gas which has already been subjected to said cooling and condensation operation.

16. An apparatus as claimed in claim 12, further comprising means for partially cooling said flue gas, prior to said cooling and condensation operation, by passing said flue gas through a steam generator, whereby a portion of the heat of said flue gas is employed for the generation of steam.

17. An apparatus as claimed in claim 11, further comprising steam and/or electricity generator means positioned for the passage therethrough of said flue gas, after the discharge thereof from said coke dry cooling plant and prior to the introduction thereof into said coal dyring and preheating plant, for employing a portion of the heat of said flue gas for the generation of steam and/or electricity.

18. An apparatus as claimed in claim 17, further comprising blower means, operated by the steam and/or electricity generated by said generator means, for conveying said flue gas through said system.

* * * * *